US008820876B2

(12) United States Patent
Hoshi et al.

(10) Patent No.: US 8,820,876 B2
(45) Date of Patent: Sep. 2, 2014

(54) PRINTING APPARATUS AND INSPECTION METHOD

(75) Inventors: Akimitsu Hoshi, Kawasaki (JP); Ryosuke Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 43 days.

(21) Appl. No.: 13/614,016

(22) Filed: Sep. 13, 2012

(65) Prior Publication Data

US 2013/0100193 A1 Apr. 25, 2013

(30) Foreign Application Priority Data

Oct. 21, 2011 (JP) ..... 2011-231288

(51) Int. Cl.

| | |
|---|---|
| ***B41J 29/38*** | (2006.01) |
| ***B41J 2/21*** | (2006.01) |
| ***B41J 11/00*** | (2006.01) |
| ***B41J 15/04*** | (2006.01) |
| ***B41J 11/42*** | (2006.01) |

(52) U.S. Cl.

CPC ..... *B41J 2/2142* (2013.01); *B41J 11/002* (2013.01); *B41J 15/04* (2013.01); *B41J 11/42* (2013.01)

USPC ..... 347/16; 347/9; 347/102; 347/104

(58) Field of Classification Search

USPC ..... 347/5, 9, 14, 16, 19, 101, 102, 104–107

See application file for complete search history.

(56) References Cited

U.S. PATENT DOCUMENTS

2011/0211011 A1 9/2011 Hashi et al.

FOREIGN PATENT DOCUMENTS

JP 2011-177954 A 9/2011

*Primary Examiner* — Juanita D Jackson

(74) *Attorney, Agent, or Firm* — Fitzpatrick, Cella, Harper & Scinto

(57) ABSTRACT

There are provided a printing apparatus and an inspection method which can reduce a position deviation of an inspection pattern upon reading the inspection pattern to perform an accurate inspection. A sheet conveyance misalignment in a continuous sheet is corrected in a corrective unit. The inspection pattern is printed on the corrected sheet by a print head of an inkjet type, and the sheet on which the inspection pattern is printed is dried. A sheet conveyance misalignment in the dried sheet is again corrected in the corrective unit, and the inspection pattern of the corrected sheet is read to perform a color shading inspection.

5 Claims, 15 Drawing Sheets

PRINTING APPARATUS AND INSPECTION METHOD

BACKGROUND OF THE INVENTION

1. Field of the Invention

The present invention to a printing apparatus and an inspection method, and particularly, to a printing apparatus and a inspection method capable of performing a color shading inspection.

2. Description of the Related Art

In the inkjet type printing apparatus, there is known a technique for inspecting an ejection failure of a nozzle, landing-on accuracy of ink, and further, color shading. Specifically an inspection pattern is printed on a sheet and the inspection pattern is read by a scanner to inspect the ejection failure of the nozzle, the landing-on accuracy of the ink, and the color shading, thus performing a color shading correction.

In regard to the ejection failure of the nozzle or the landing-on accuracy of the ink, immediately after the inspection pattern is printed on the sheet, the sheet is conveyed, wherein the inspection pattern can be read by the scanner. However, the inspection pattern for detecting the color shading changes in color shading between a state where the ink is not yet dried immediately after the inspection pattern is printed and a state where the ink is dried. Therefore for accurately detecting the color shading, it is required to perform the inspection after the inspection pattern is dried.

Japanese Patent Laid-Open No. 2011-177954 discloses a technique in which a color shading inspection pattern is dried in a drying unit provided in a printing apparatus, and then the inspection pattern is read by the scanner. According to this technique, the color shading inspection pattern is conveyed in such a manner as to pass under the drying unit provided downstream of the scanner in the printing apparatus, and the sheet is conveyed in a direction opposing the conveying direction after all the regions of the inspection pattern are dried, to read the dried inspection pattern by the scanner.

In the apparatus disclosed in Japanese Patent Laid-Open No. 2011-177954, the sheet on which the dried inspection pattern is printed is reeled in a reeling unit and is afterward conveyed back to the upstream side of the scanner, wherein the inspection pattern is read by the scanner. However, there is a possibility that a conveyance misalignment of the sheet (position deviation or inclination of the sheet in the sheet width direction) occurs during the sheet conveying at the time of the conveying-back operation. When the conveyance misalignment of the sheet occurs, the inspection pattern also deviates from an original position. When the inspection pattern deviating from the original position is read by the scanner, a corresponding relation between the nozzle and the color shading inspection pattern is in error and therefore it is hard to accurately detect the actual color shading, leading to a possibility of performing an erroneous color shading correction.

SUMMARY OF THE INVENTION

Therefore the present invention is made in view of the foregoing problems, and an object of the present invention is to provide a printing apparatus and an inspection method which can reduce a position deviation of an inspection pattern upon reading the inspection pattern to perform an accurate inspection.

A printing apparatus according to the present invention relates to a printing apparatus for applying ink on a continuous sheet to perform printing thereon, comprising: a printing unit including a print head of an inkjet type; a corrective unit positioned upstream of the printing unit to correct a conveyance misalignment of the sheet on which the printing is performed by the printing unit; a reading unit positioned downstream of the printing unit to read an inspection pattern which is printed on the sheet by the printing unit; a drying unit configured to dry the sheet on which the ink is applied by the printing unit; and a control unit, wherein based upon control of the control unit, the sheet on which the inspection pattern is printed is dried by the drying unit, and the sheet is afterward corrected by the corrective unit to read the inspection pattern by the reading unit.

According to the present invention, the sheet conveyance misalignment of the sheet on which the inspection pattern is printed is corrected in the corrective unit upon reading the inspection pattern. Therefore the pattern position deviation upon reading the inspection pattern can be reduced to perform an accurate inspection.

Further features of the present invention will become apparent from the following description of exemplary embodiments (with reference to the attached drawings).

DESCRIPTION OF THE EMBODIMENTS

Hereinafter, embodiments according to the present invention will be in detail explained with reference to the accompanying drawings.

Figure 1:
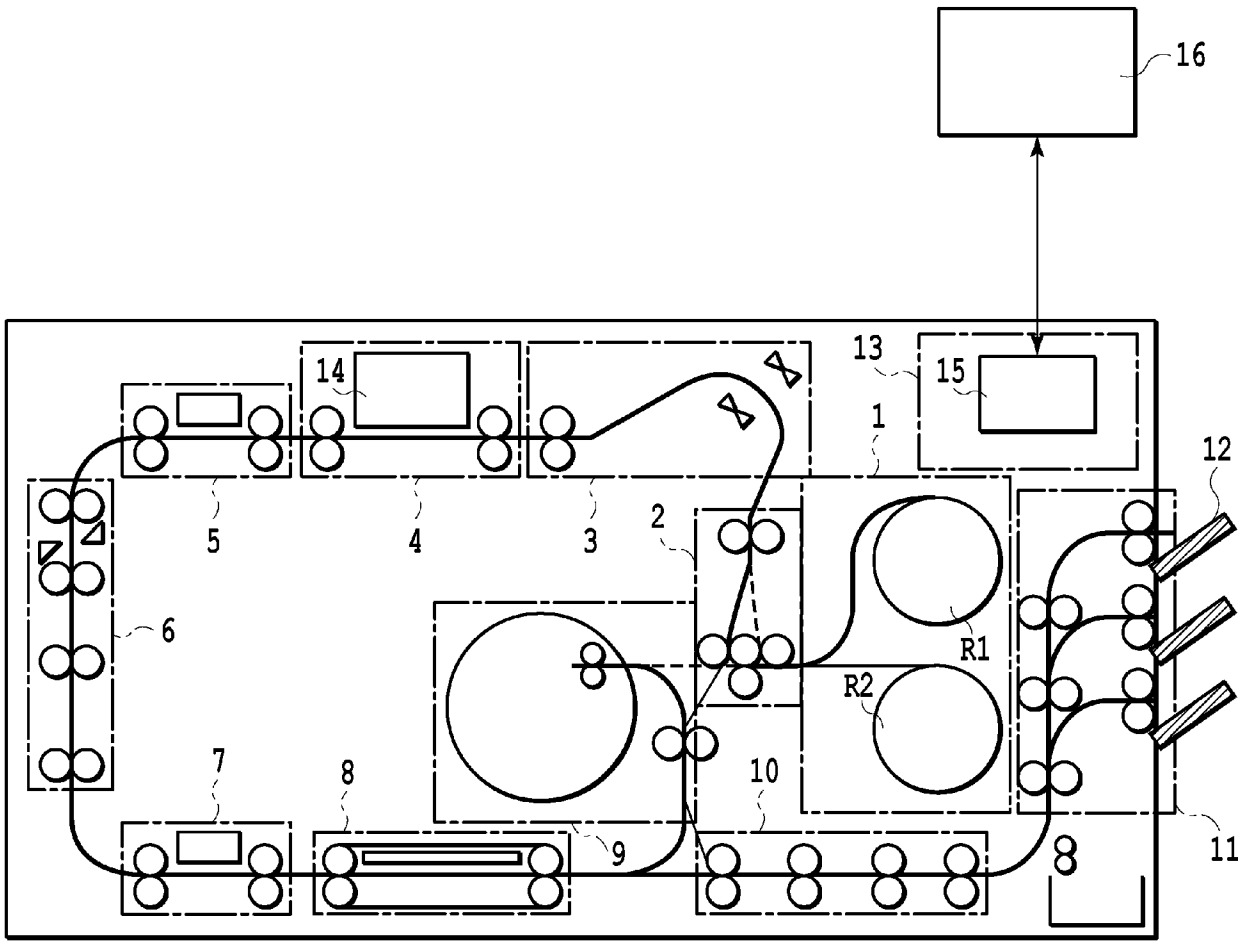
FIG. 1 is a schematic cross section showing the internal structure of a printing apparatus in an embodiment of the present invention.

FIG. 1 is a schematic cross section showing the internal structure of a printing apparatus in the present embodiment. The printing apparatus in the present embodiment uses a continuous sheet wound in a rolling shape and is a high-speed printer applicable to both of one-surface printing and both-surface printing. This printing apparatus is suitable for the field of printing a great number of sheets and, for example, is used for printing in a print laboratory.

A sheet supply unit 1 inside the printing apparatus is a unit for holding and supplying the continuous sheet wound in the rolling shape. The sheet supply unit 1 is structured in such a manner as to be capable of holding two rolls R1 and R2 and selectively pull out the sheet for supply. It should be noted that in the present embodiment, the two rolls can be held in the sheet supply unit 1, but the number of the rolls which can be held therein is not limited to two, but one, three or more. The sheet is conveyed along a sheet conveying path shown in a solid line in the figure by a conveyance mechanism composed of paired rollers and a belt, and is processed by each unit.

A decal unit 2 is a unit for reducing a curl of the sheet supplied from the sheet supply unit 1, and uses two pinch rollers to one drive roller to curve the sheet in such a manner as to provide a curl in a reverse direction to the curl for wringing, thus reducing the curl of the sheet.

A sheet corrective unit 3 is a unit for correcting a conveyance misalignment of the sheet passing the decal unit 2. Examples of the conveyance misalignment of the sheet include a position deviation of the sheet in the sheet width direction from the original forward direction (serpentine movement) and an inclination to the original forward direction (oblique movement). In the sheet corrective unit 3, a sheet end portion closer to a reference is pressed against a guide member to correct the position deviation in the sheet width direction and the inclination.

A printing unit 4 is a unit for forming an image onto the sheet conveyed, by print heads 14. The printing unit 4 is provided with a plurality of conveying rollers for conveying the sheet. The print head 14 includes a line type print head in which an inkjet type of nozzle rows is formed in a range covering the maximum width of the sheet expected to be used. A plurality of the print heads 14 are arranged in parallel along the conveying direction. The present embodiment includes seven print heads corresponding to seven colors of C (cyan), M (magenta), Y (yellow), LC (light cyan), LM (light magenta), G (gray), and K (black). It should be noted that the color number and the number of the print heads are not limited to seven, but the other color may be added, and not all the above colors may be included. Examples of the inkjet type may include a type using a heater element, a type using a piezo element, a type using electrostatic element, and a type using an MEMS element. The ink of each color is supplied to the print head 14 through each ink tube from an ink tank.

A reading unit 5 including a scanner is a unit for optically reading an inspection pattern or an image which is printed on the sheet by the printing unit 4 to inspect a state of the nozzle in the print head, a sheet conveying state, an image position, and the like. The reading unit 5 is structured of a scanner unit 104 for actually reading an image, and an image processing unit for processing the read image.

A dust bin 11 shows a region for storing the inspection pattern obtained by the cutting in a cutter unit 6 and read.

Figure 2:
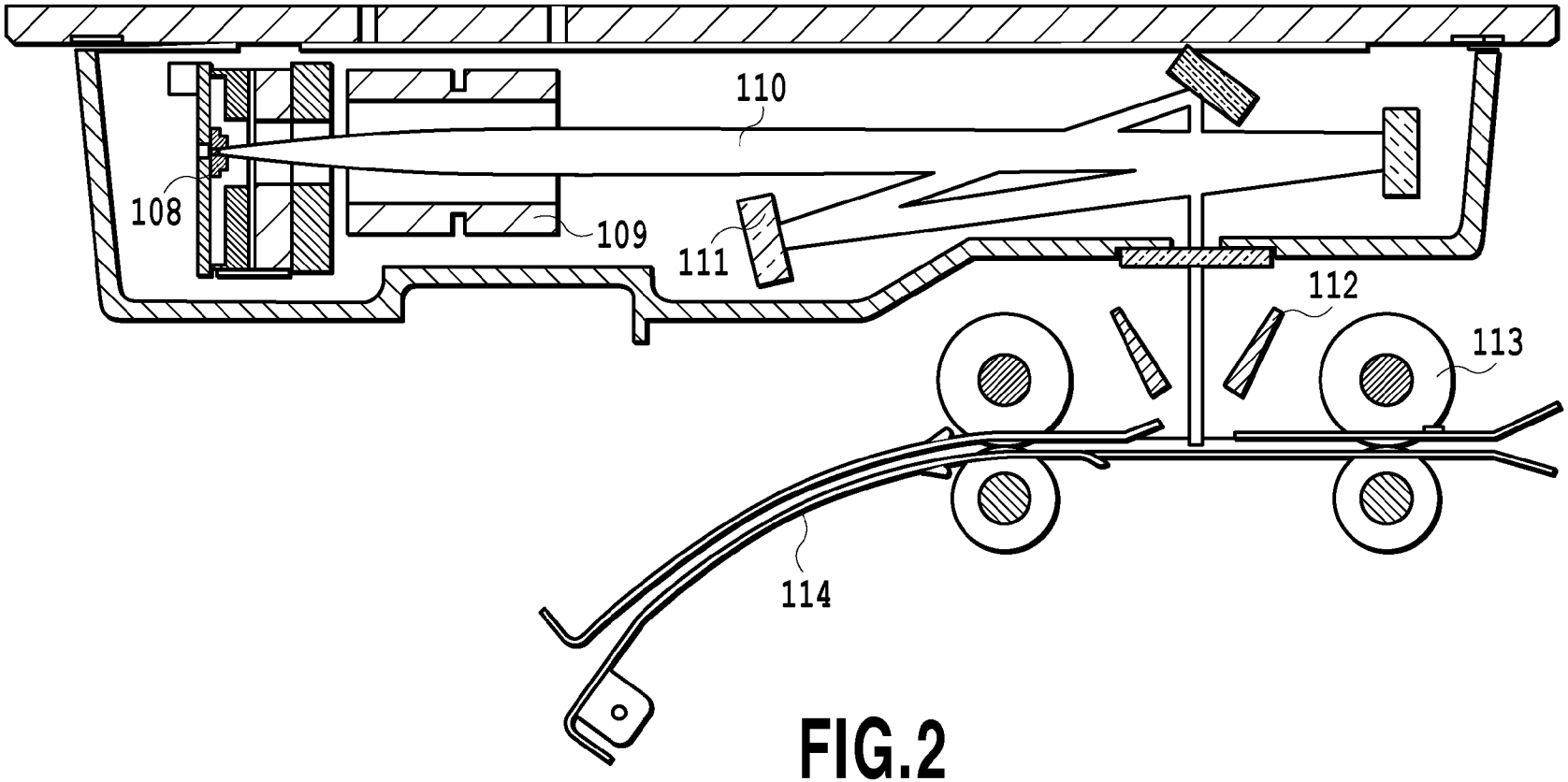
FIG. 2 is a detailed diagram showing a scanner unit.

FIG. 2 is a detailed diagram showing the scanner unit 109. A document guided by a paper conveying guide plate 119 passes the reading unit at a predetermined speed by conveying rollers 113. The document in the reading unit is illuminated by a document illuminating apparatus 112. A path of light traveling from the document through a lens 109 to a CCD 108 turns back by a mirror 111, which thereafter passes the lens 109 and is collected to the CCD 108 for converting light into an electrical signal. The image information converted into the electrical signal by the CCD 108 is delivered to the image processing unit for analysis. The image analysis may be processed by a controller 15.

Referring to FIG. 1 again, the cutter unit 6 is a unit provided with a mechanical cutter for cutting the printed sheet to a predetermined length. The cutter unit 6 is provided with a plurality of conveying rollers for conveying out the sheet to the next process.

An information printing unit 7 is a unit for printing print information such as serial numbers and dates of the printing on the backside of the cut sheet.

A drying unit 8 is a unit for heating the sheet printed in the printing unit 4 to dry the applied ink in a short time. The drying unit 8 is also provided with a conveying belt and conveying rollers for conveying out the sheet to the next process.

A sheet reeling unit 9 is a unit for temporarily reeling the continuous sheet on which the front-surface printing is completed at both-surface printing. The sheet reeling unit 9 is provided with a reeling drum rotating for reeling the sheet. The continuous sheet the printing on the front surface of which is completed and which is not cut is temporarily reeled by the reeling drum. When the reeling of the sheet is completed, the reeling drum rotates reversely to supply the reeled sheet to the decal unit 2 and be conveyed to the printing unit 4. This sheet is reversed in the front-back relation, and therefore printing can be performed on the back surface in the printing unit 4. A more specific operation of the both-surface printing will be described later.

A discharge conveying unit 10 is a unit for conveying the sheet which is cut by the cutter unit 6 and dried by the drying unit 8, and delivering the sheet to a sorter unit 11. The sorter unit 11 is a unit for allotting the printed sheets to different discharge trays 12 for each group of the sheets as needed for discharge.

A control unit 13 is a unit for managing control of each unit in the entire printing apparatus. The control unit 13 includes a controller 15 provided with a CPU, a memory, and various I/O interfaces, and a power source. An operation of the printing apparatus is controlled based upon a command from the controller 15 or from an external device 16 such as a host computer connected through the I/O interface to the controller 15.

Next, a basic operation of the printing apparatus at printing will be explained. Since the printing operation differs between one-surface printing and both-surface printing, the respective printing operations will be explained.

Figure 3:
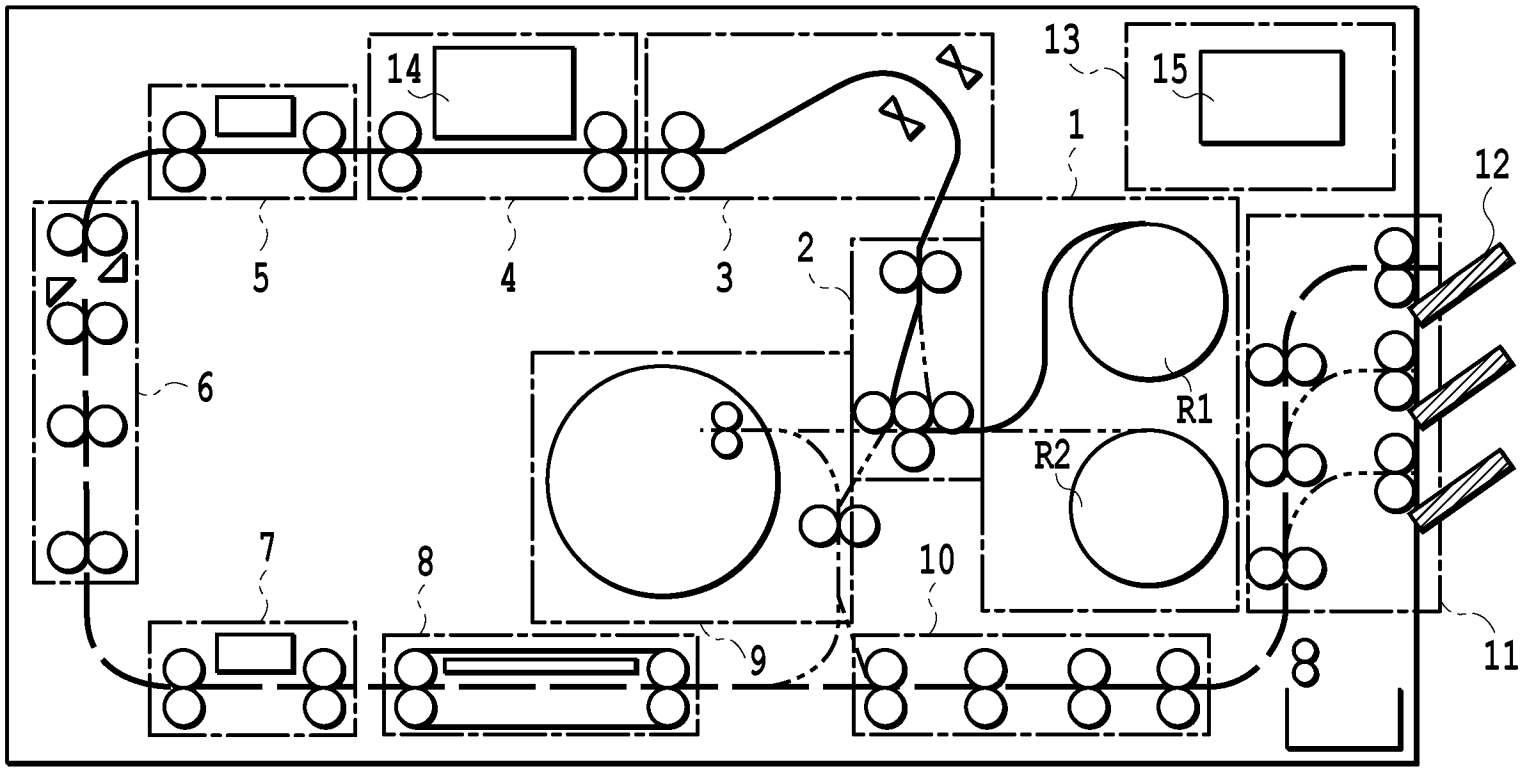
FIG. 3 is a diagram explaining an operation of the printing apparatus at one-surface printing.

FIG. 3 is a diagram for explaining the operation at one-surface printing. In the figure, a conveying path from a point where a sheet is supplied from the sheet supply unit 1 for printing to a point where the sheet is discharged to the discharge tray 12 is shown in a heavy line. First, the sheet is supplied from the sheet supply unit 1, a curl of the sheet is reduced by the decal unit 2, and a conveyance misalignment of the sheet is corrected by the sheet corrective unit 3. Then printing is performed onto the front surface of the sheet by the printing unit 4. The printed sheet is conveyed via the reading unit 5 and is cut for each predetermined unit length preset, in the cutter unit 6. In the cut sheet, the print information is printed on the back surface of the sheet in the information printing unit 7 as needed. The cut sheets are conveyed one by one to the drying unit 8 for drying. Afterward the sheets go via the discharge conveying unit 10, and are sequentially discharged and loaded on the trays 12 of the sorter unit 11.

Figure 4:
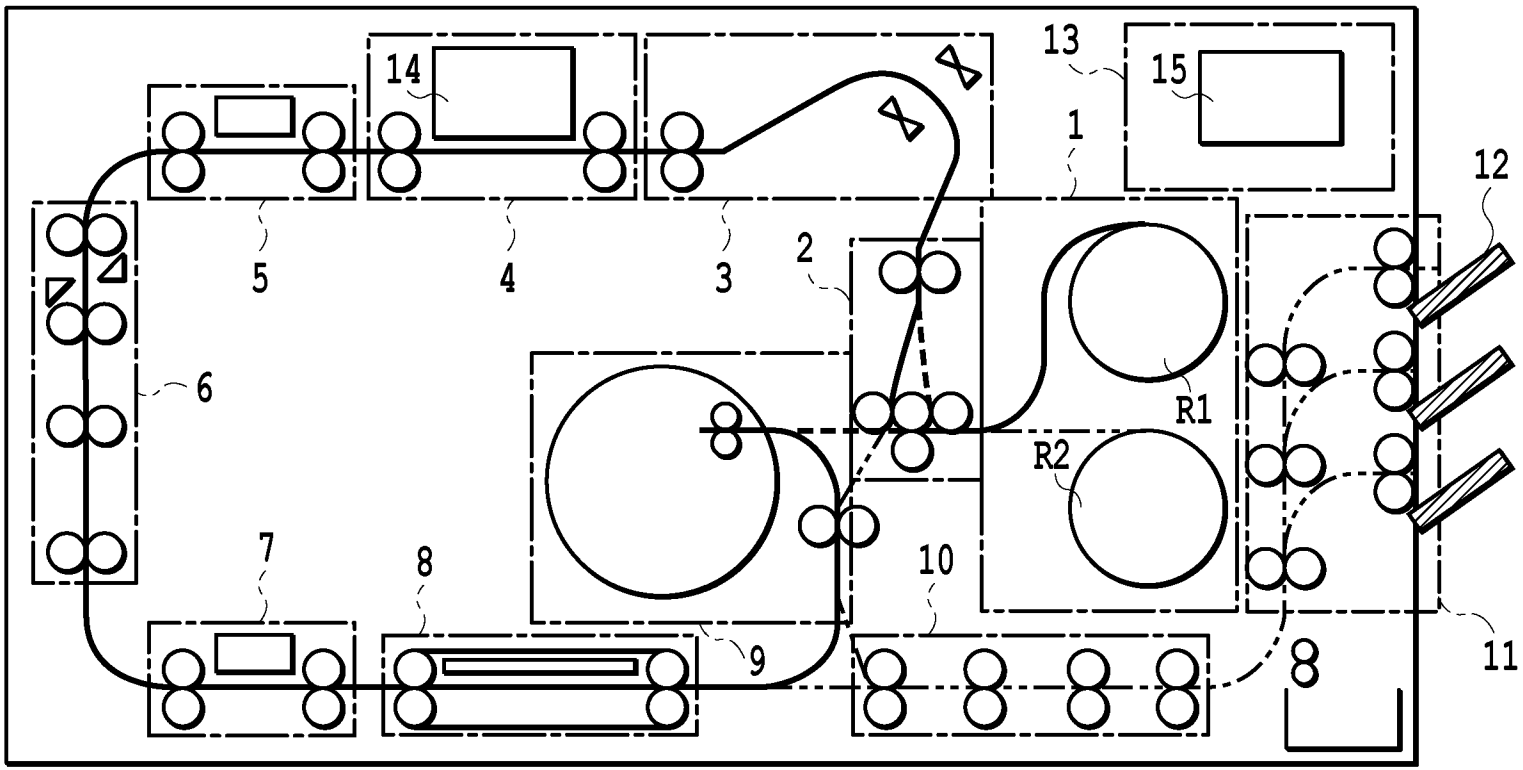
FIG. 4 is a diagram explaining an operation of the printing apparatus at both-surface printing.

FIG. 4 is a diagram for explaining the operation at both-surface printing. At both-surface printing, the back-surface printing sequence is performed following the front-surface printing sequence. In the first front-surface printing sequence, the operation of each unit from the sheet supply unit 1 to the reading unit 5 is the same as the operation at the one-surface printing as described above. The cut operation is not performed in the cutter unit 6, but the continuous sheet is conveyed to the drying unit 8 as it is. The sheet is, after drying the ink on the front surface of the sheet in the drying unit 8, guided not in the path in a side of the discharge conveying unit 10, but in the path in a side of the sheet reeling unit 9. The guided sheet is reeled on the reeling drum of the sheet reeling unit 9 rotating in the forward direction (in a counter-clockwise direction in the figure). When the printing onto the front surface to be expected is all completed in the printing unit 4, a rear end of the continuous sheet in the print region is cut in the cutter unit 6. The continuous sheet downstream of the cut position in the conveying direction (printed side) goes through the drying unit 8, and is all reeled to the sheet end (cut position) in the sheet reeling unit 9. On the other hand, the continuous sheet upstream of the cut position in the conveying direction is reeled back to the sheet supply unit 1 such that the sheet front end (cut position) does not remain in the decal unit 2.

The printing operation is switched to the back-surface printing sequence following the above front-surface printing sequence. The reeling drum of the sheet reeling unit 9 rotates in a reverse direction (clockwise direction in the figure) to a direction at reeling. An end portion of the reeled sheet (the sheet rear end at reeling is a sheet front portion at feeding-out) is conveyed into the decal unit 2. In the decal unit 2, the curl correction is performed in a reverse direction to the previous sequence, and simultaneously the sheet is reversed in the front-back relation in the conveying path inside the decal unit 2. Afterward the sheet goes through the sheet corrective unit 3, and then printing is performed on the back surface of the sheet in the printing unit 4. The printed sheet goes through the reading unit 5, and is cut for each predetermined unit length preset in the cutter unit 6. Since the printing is performed on both the surfaces of the cut sheet, printing onto the cut sheet is not performed in the information printing unit 7. The cut sheets are conveyed one by one to the drying unit 8, go through the discharge conveying unit 10, and are sequentially discharged and loaded to the sheet trays 12 in the sorter unit 11.

The printing apparatus according to the present embodiment can selectively perform the color shading inspection and the ejection failure inspection.

First, the ejection failure inspection method will be explained. In the ejection failure inspection, the ejection failure of a nozzle due to clogging of the ink or solidification of the ink in the nozzle of the print head is detected. In the ejection failure inspection, an ejection failure inspection pattern is printed on a sheet by the print head 14 in the printing unit 4, and the printed ejection failure inspection pattern is read by the scanner. The ejection failure nozzle is identified from the printed inspection pattern, and suction and forcible ejection are performed to the nozzle to perform cleaning of the nozzle, thus eliminating the ejection failure.

Figure 5:
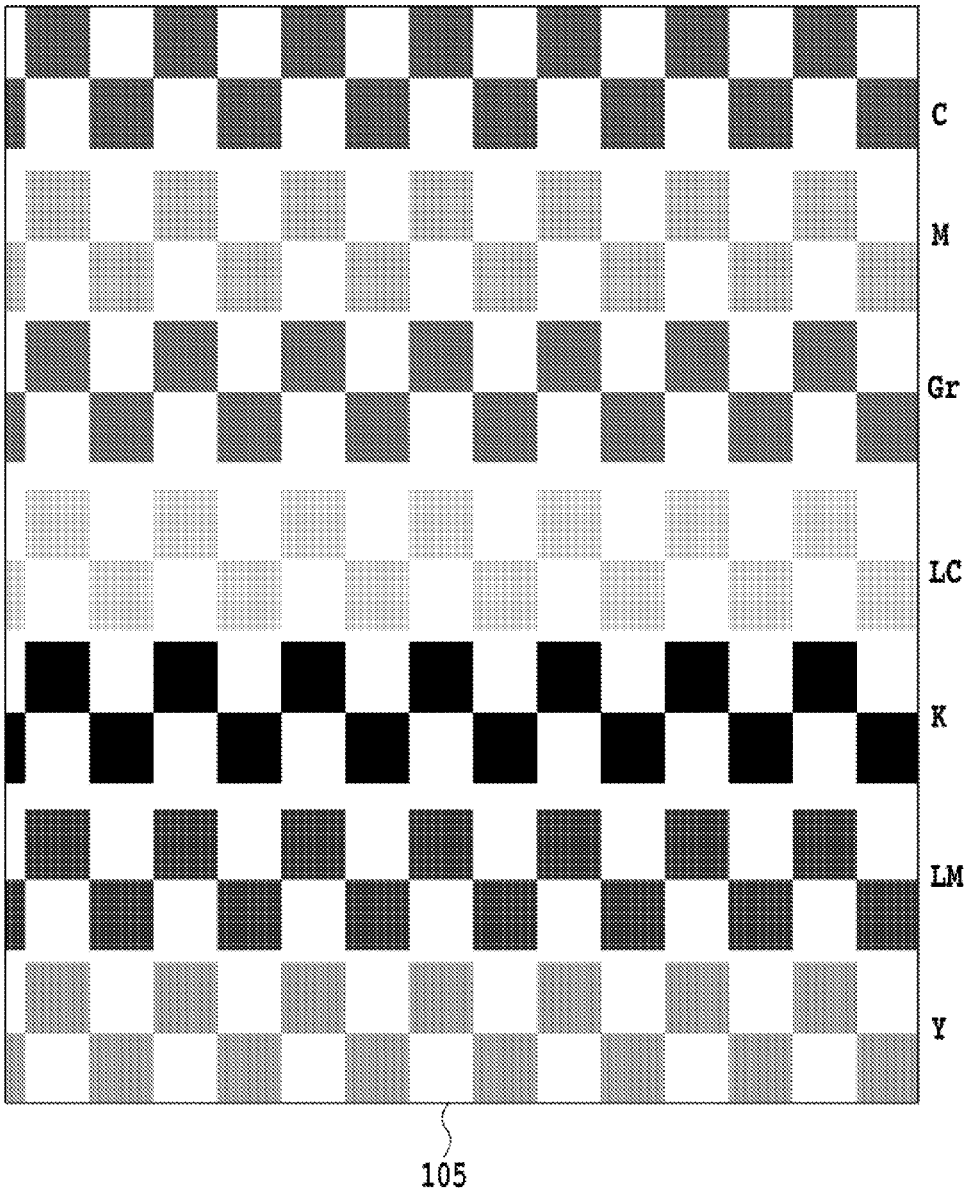
FIG. 5 is a diagram showing an ejection failure inspection pattern for performing an ejection failure inspection.
Figure 6:
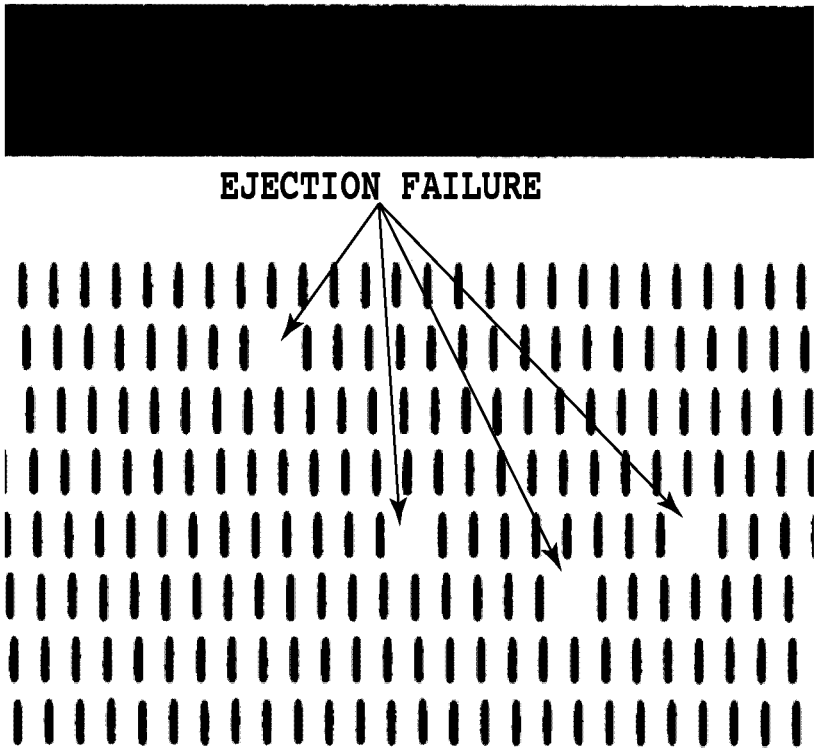
FIG. 6 is a diagram shown by enlarging a part of the ejection failure inspection pattern shown in FIG. 5.

FIG. 5 is a diagram showing the ejection failure inspection pattern for performing the ejection failure inspection. FIG. 6 is a partially enlarged diagram of the ejection failure inspection patter shown in FIG. 5. By referring to FIG. 6, the line is drawn one by one by the ink ejected from one predetermined nozzle hole. On the spot where the line is not drawn, the ink is not ejected from the nozzle. That is, the ejection failure occurs thereon.

Figure 7:
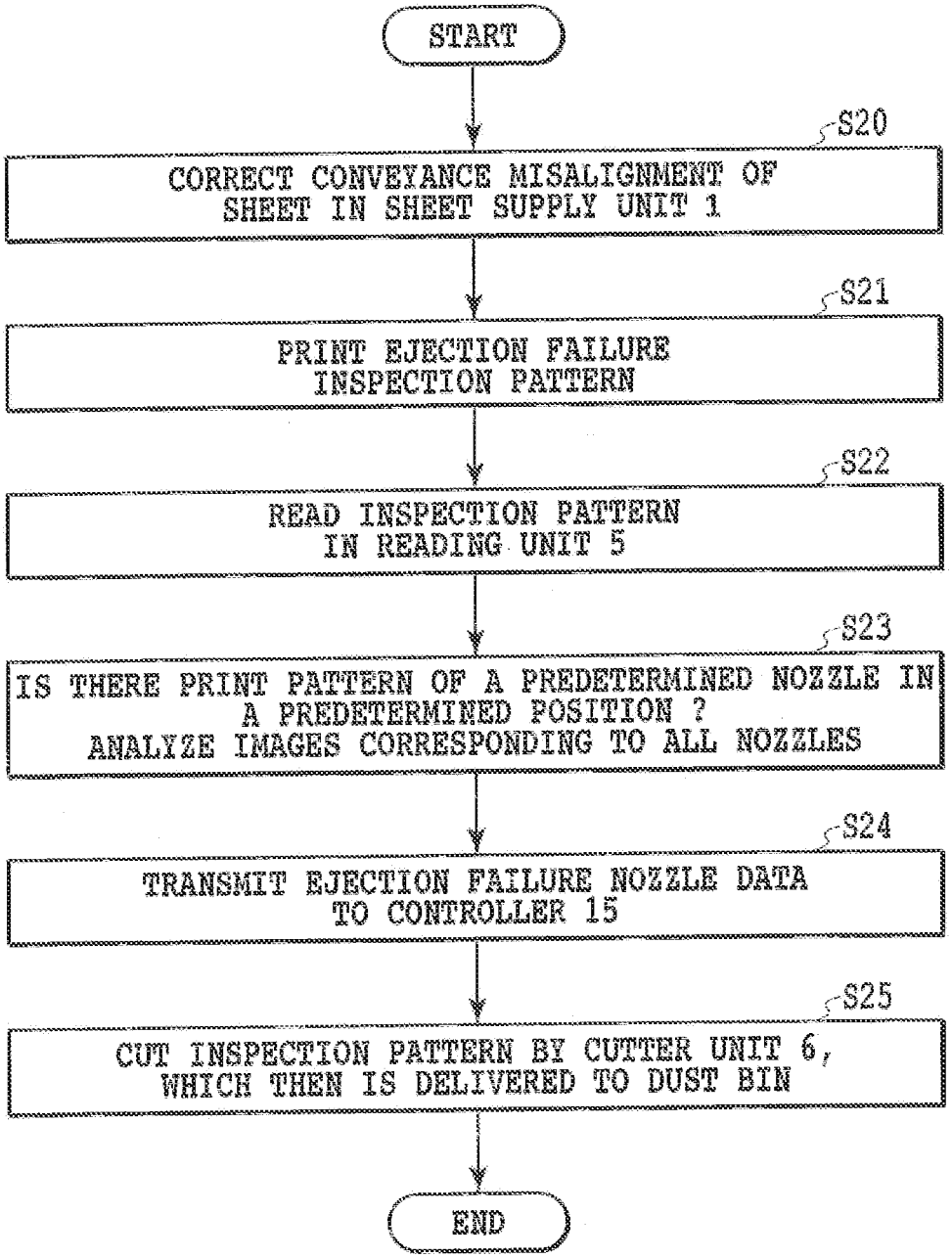
FIG. 7 is a flow chart showing the procedure of the ejection failure inspection.

FIG. 7 is a flow chart showing the procedure of the ejection failure inspection. When the sequence of the ejection failure inspection starts, a conveyance misalignment (oblique movement or serpentine movement) of a sheet conveyed out from the sheet supply unit 1 is corrected in the sheet corrective unit 3 (step S20). The ejection failure inspection pattern shown in FIG. 5 is printed on the corrected sheet by the print head in the printing unit 4 (step S21). The ejection failure inspection pattern printed on the sheet is read by the scanner (step S22). Images in regard to all nozzles are analyzed on whether or not an ejection failure inspection pattern of a predetermined nozzle exists in a predetermined position, based upon data of the read ejection failure inspection pattern (step S23). The data of the analyzed ejection failure inspection pattern is transmitted to the controller 15 (step S24). Afterward, the sheet on which the ejection failure inspection pattern is printed is cut in the cutter unit 6, which is then discharged into the dust bin (step S25).

The single print head includes about 0.8 millions of nozzles, and for inspecting them one by one, the ejection failure inspection pattern is required to have a length of the order of 500 mm. The analysis is performed on how extent the ejection failure occurs on a density basis by the nozzle numbers of the ejection failure. In a case where the density of the ejection failure is less than a predetermined value, the ejection number of the adjacent nozzle is increased to perform the ejection failure supplement. In a case where the density of the ejection failure is the predetermined value or more, it is determined that the supplement can not be performed, and cleaning of the nozzle is performed by suction and forcible ejection to eliminate the ejection failure of the nozzle. Afterward, the ejection failure inspection is once more performed. When the ejection failure density is less than the predetermined value, the ejection failure supplement is performed to re-start the printing operation. Even so, in a case where the density of the ejection failure is the predetermined value or more, a print error is displayed to stop the printing operation.

The ejection failure inspection pattern used for the ejection failure inspection is read by the scanner without the drying in the drying unit 8. This is because since the ejection failure inspection is used for detecting an ejection failure location of the nozzle, data required for the inspection does not change either dried or not dried.

Next, the color shading inspection method will be explained. In an in-line type printing apparatus in which print heads of plural chips line up in a range over the sheet width, there are some cases where without any color shading correction, the ejection amount of ink varies for each chip to produce a concentration gap between the adjacent connecting portions. Since the ejection amount changes within the same chip, in some cases the uniform, concentration can not be produced unless the ejection strength is made to change for each nozzle. Further, error dispersion or the like is used for reproducing the concentration, but it is difficult to obtain the perfect concentration linearity. In a case of mixing the inks, in many cases a second-order color or a third-order color difficult to reproduce a color is produced.

For correcting the concentration gap due to a variation for each chip, irregularity of the concentration due to a change of the ejection amount within the same chip and the like, the color shading inspection is performed to perform the color conversion of the print data or the like. That is, the color shading inspection pattern is read by the scanner and the ink ejection amount is finely controlled, thus producing an accurate color. Specifically head shading, color shading, PWM control, and the like may be used.

The PWM control roughly controls power supplied to the print head chip, and controls the average ejection amount of ink for each chip. The head shading controls ejection energy in a unit of several nozzles, and also controls an ejection error dispersion pattern, thereby performing the concentration linearity control. The color shading inspects a second-order color and a third-order color, and performs color conversion of data before being printed, which is provided to the printing apparatus, thus performing color matching.

Figure 8:
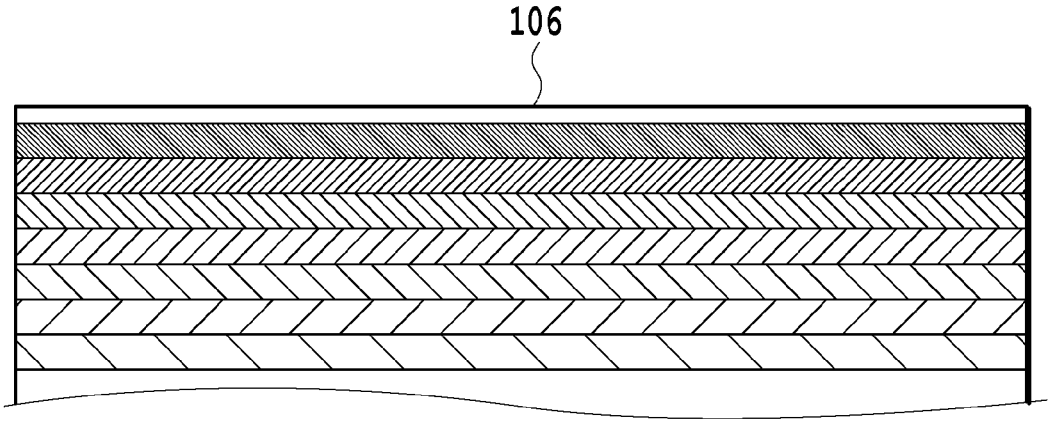
FIG. 8 is a diagram showing an example of a color shading inspection pattern.

FIG. 8 is a diagram showing an example of the color shading inspection pattern. Such a color shading inspection pattern is printed by the print head 14 in the printing unit 4. Reading-in of the pattern is performed by the scanner in the reading unit 5. In the color shading detection for control of them, a high resolution of the scanner is not so much highly required, but a high gradation level is required. Specifically 16 bits/pixel are required.

In the color shading inspection method, in a case of printing the color shading pattern in the inkjet type, accurate coloring is not guaranteed until the ink struck onto the sheet dries. That is, for reading the color shading of the ink printed on the color shading inspection pattern, there is a possibility that meaningless data is produced in a case of reading the inspection pattern immediately after the printing. Therefore in the present embodiment, after printing the color shading inspection pattern, the drying of the inspection pattern is promoted by the drying unit 8.

Figure 9:
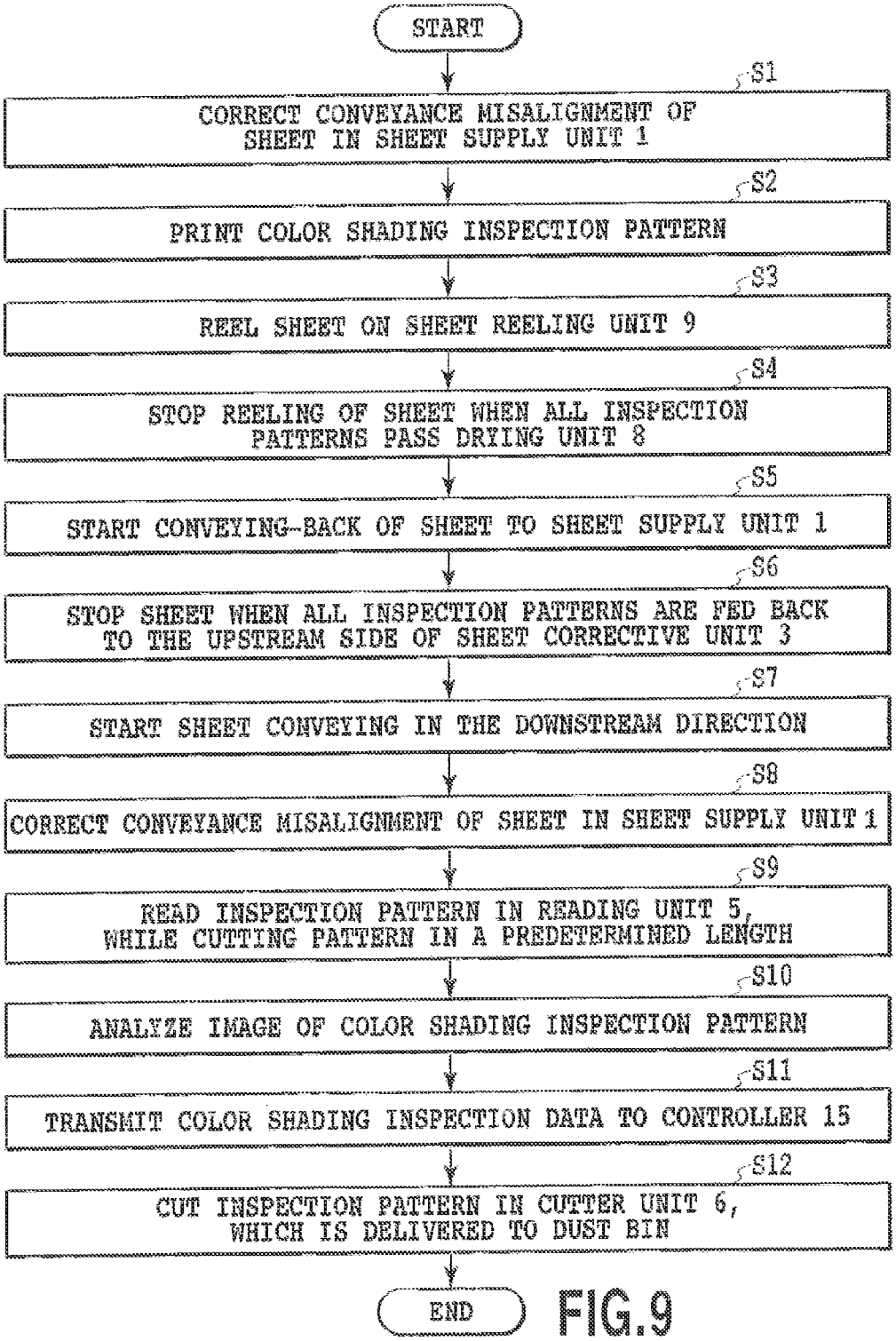
FIG. 9 is a flow chart showing the procedure of the color shading inspection.

FIG. 9 is a flow chart showing the procedure of the color shading inspection. When the sequence of the color shading correction starts, a conveyance misalignment (oblique movement or serpentine movement) of a sheet conveyed out from the sheet supply unit 1 is corrected in the sheet corrective unit 3 (step S1). The inspection pattern for the color shading inspection shown in FIG. 8 is printed on the corrected sheet (step S2). The sheet on which the inspection pattern is printed is conveyed through the cutter unit 6 and the drying unit 8, and guided to the reeling unit 9 (step S3).

Figure 10:
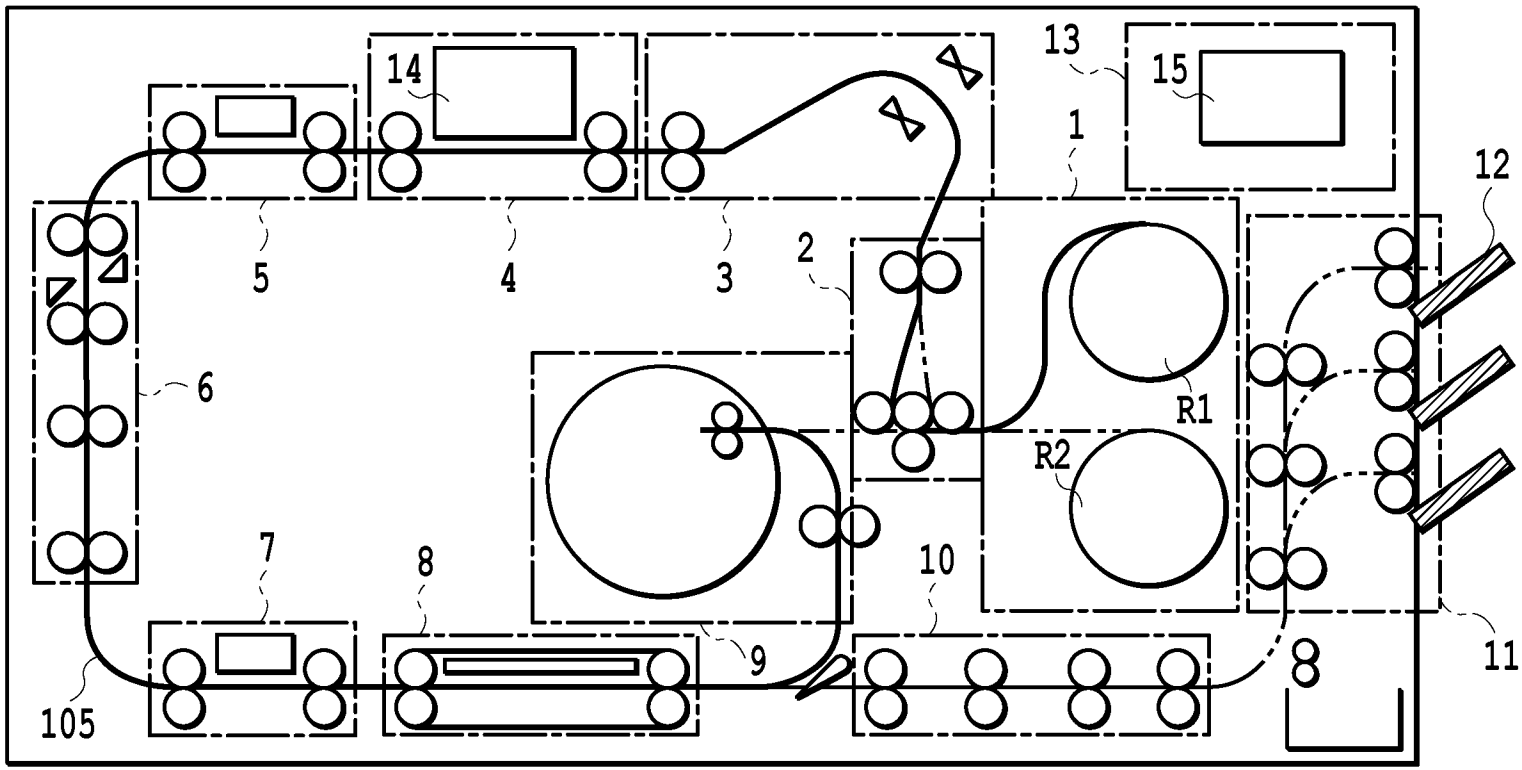
FIG. 10 is a diagram showing a state where the color shading inspection pattern is guided in a reeling unit.

FIG. 10 is a diagram showing a state where the sheet on which the inspection pattern is printed is guided to the reeling unit 9. The sheet front portion is guided to the reeling unit 9.

By referring to FIG. 9 again, the sheet is reeled on the reeling unit 9 until all the inspection patterns pass through the drying unit 8, and the reeling operation is stopped when all the inspection patterns are dried (step S4).

Figure 11:
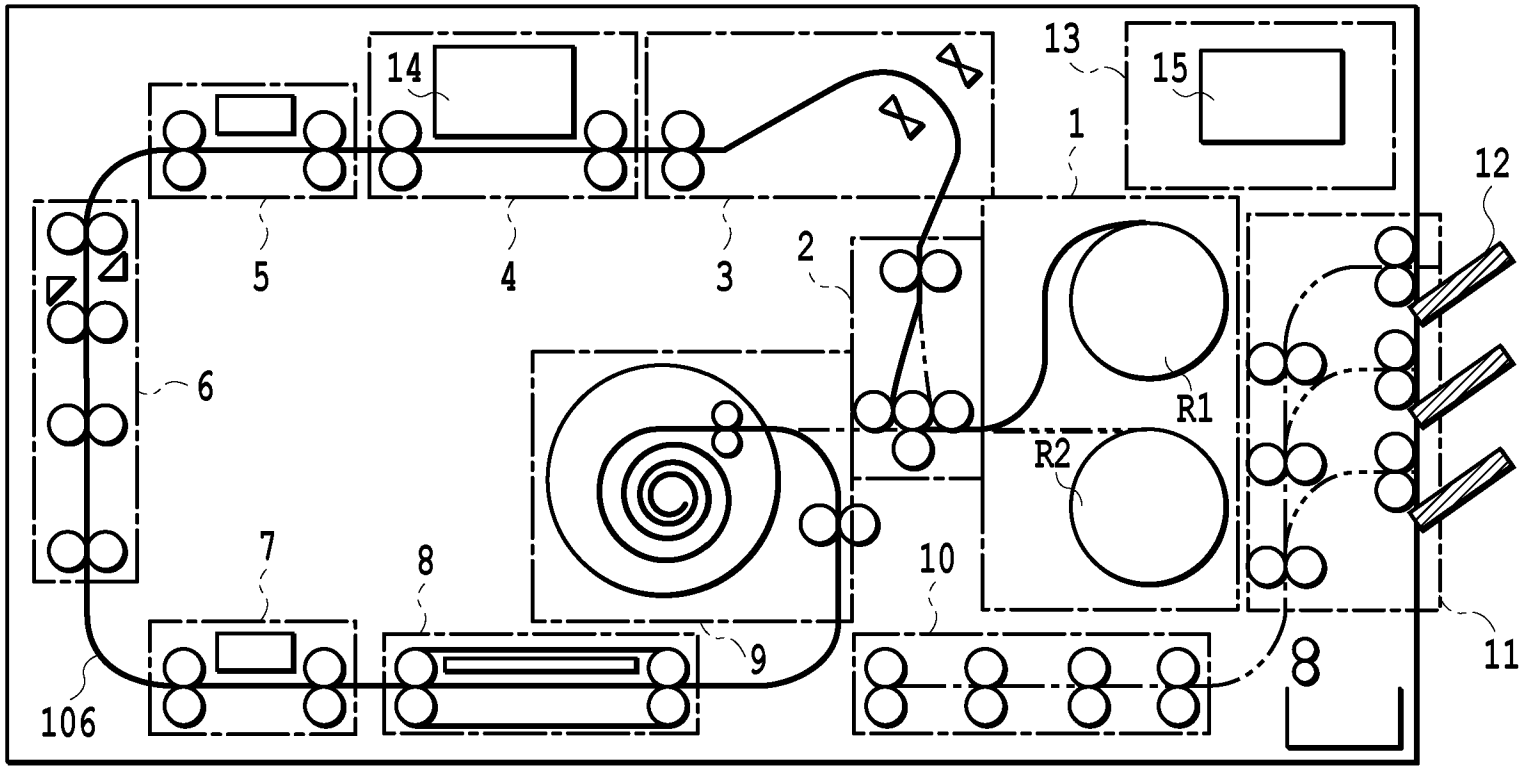
FIG. 11 is a diagram showing a state where printing of all the inspection patterns is completed.

FIG. 11 is a diagram showing a state where the printing of all the inspection patterns is completed and the conveyed sheet is reeled on the reeling unit 9. All the inspection patterns pass through the drying unit 8 to be dried, and are reeled on the reeling unit 9.

By referring to FIG. 9 again, the sheet on which the inspection pattern is printed is conveyed back in the reverse direction in such a manner as to be reeled back to the sheet supply unit 1 (step S5). When at least all the inspection patterns, preferably the sheet front end is conveyed back to the upstream side of the sheet corrective unit 3, the feeding-back operation is stopped (step S6).

Figure 12:
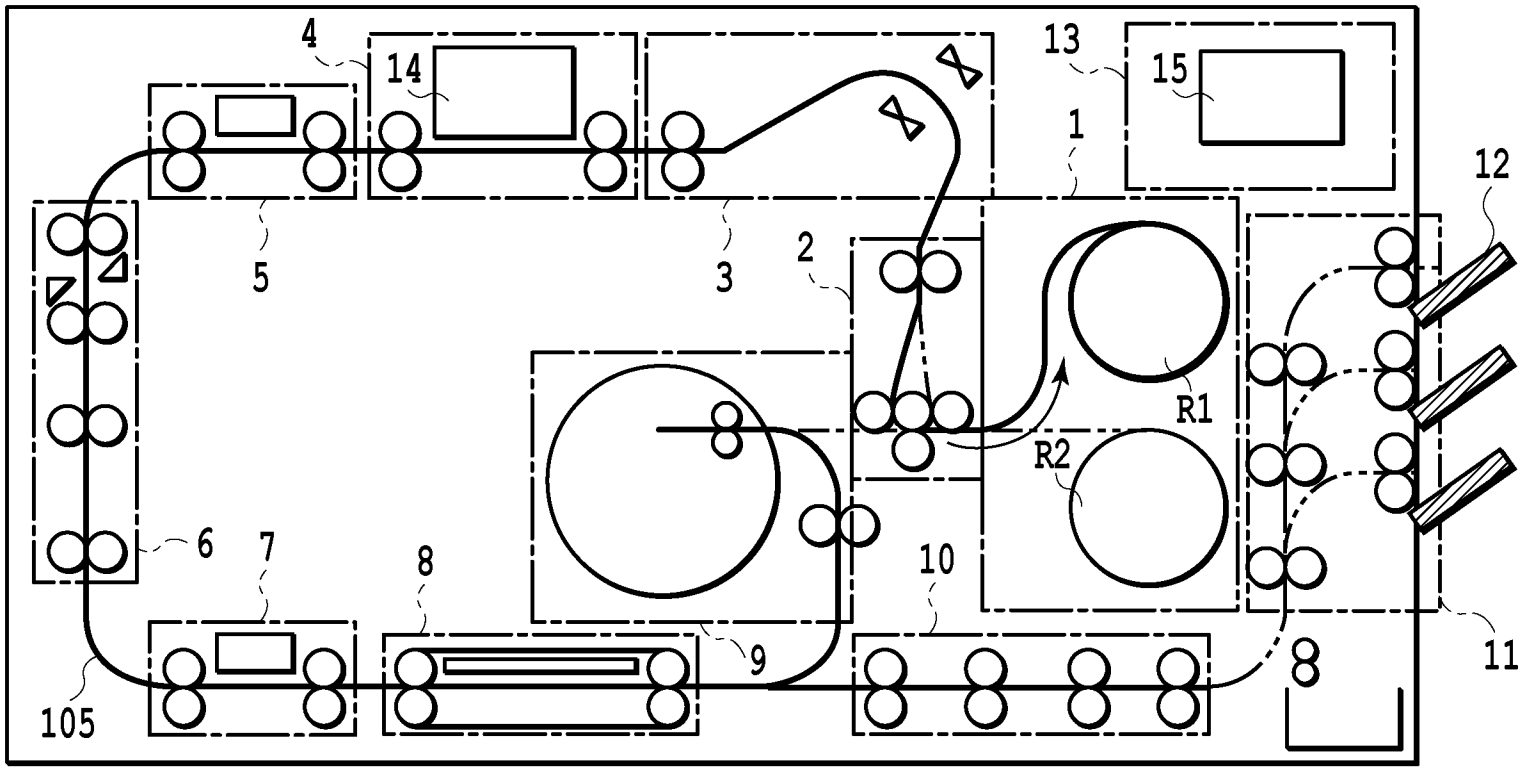
FIG. 12 is a diagram showing a state in the middle of conveying back a sheet.

FIG. 12 is a diagram showing a state where the sheet on which the inspection pattern is printed is conveyed back. The sheet on which the inspection pattern is printed is conveyed back to the roller in the sheet supply unit 1. The feeding-back distance is a distance to the extent that at least all of the printed inspection patterns come to the upstream side over the sheet corrective unit 3. Preferably the feeding-back distance is a distance to the extent that the sheet front end comes to the upstream side over the sheet corrective unit 3. The entire sheet may be conveyed back to the sheet supply unit 1. For shortening the feeding-back time, the reeling speed is increased after the front end of the sheet passes over the reading unit 5.

Figure 13:
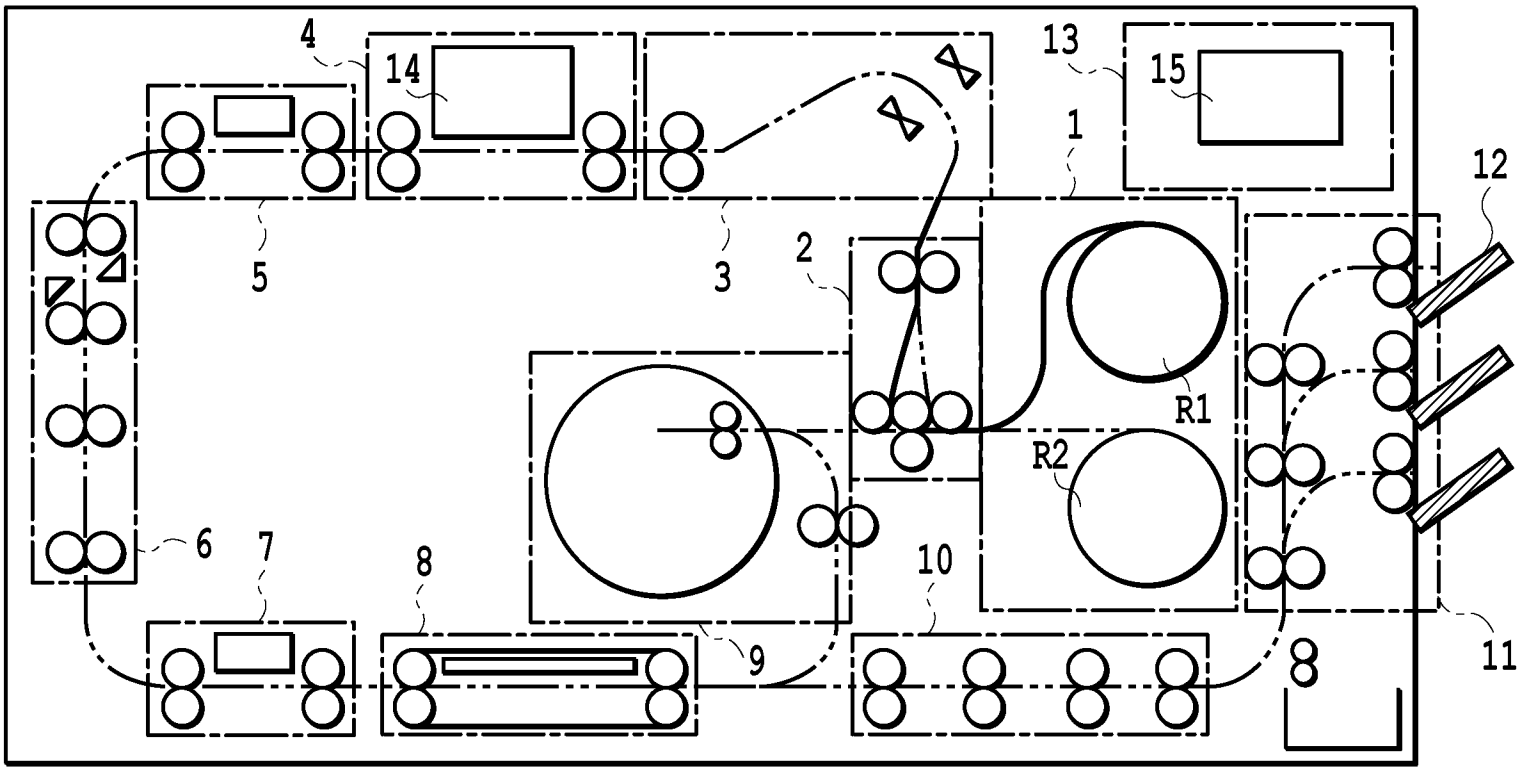
FIG. 13 is a diagram showing a state where the conveying-back operation of the sheet is completed and the sheet is stopped.

FIG. 13 is a diagram showing a state where the feeding-back operation is completed and the sheet is stopped. In the present embodiment, the sheet is conveyed back until the front end comes to a position between the decal unit 2 and the sheet corrective unit 3, and then is stopped.

By referring to FIG. 9 again, after step S15, the sheet which is conveyed back to the upstream side and on which the inspection pattern is printed is again conveyed and conveyed out to the downstream side (step S7). In regard to the conveyed-out sheet, at least the entire region where the inspection pattern is printed passes the sheet corrective unit 3, wherein the conveyance misalignment of the sheet is again corrected (step S8).

Figure 14:
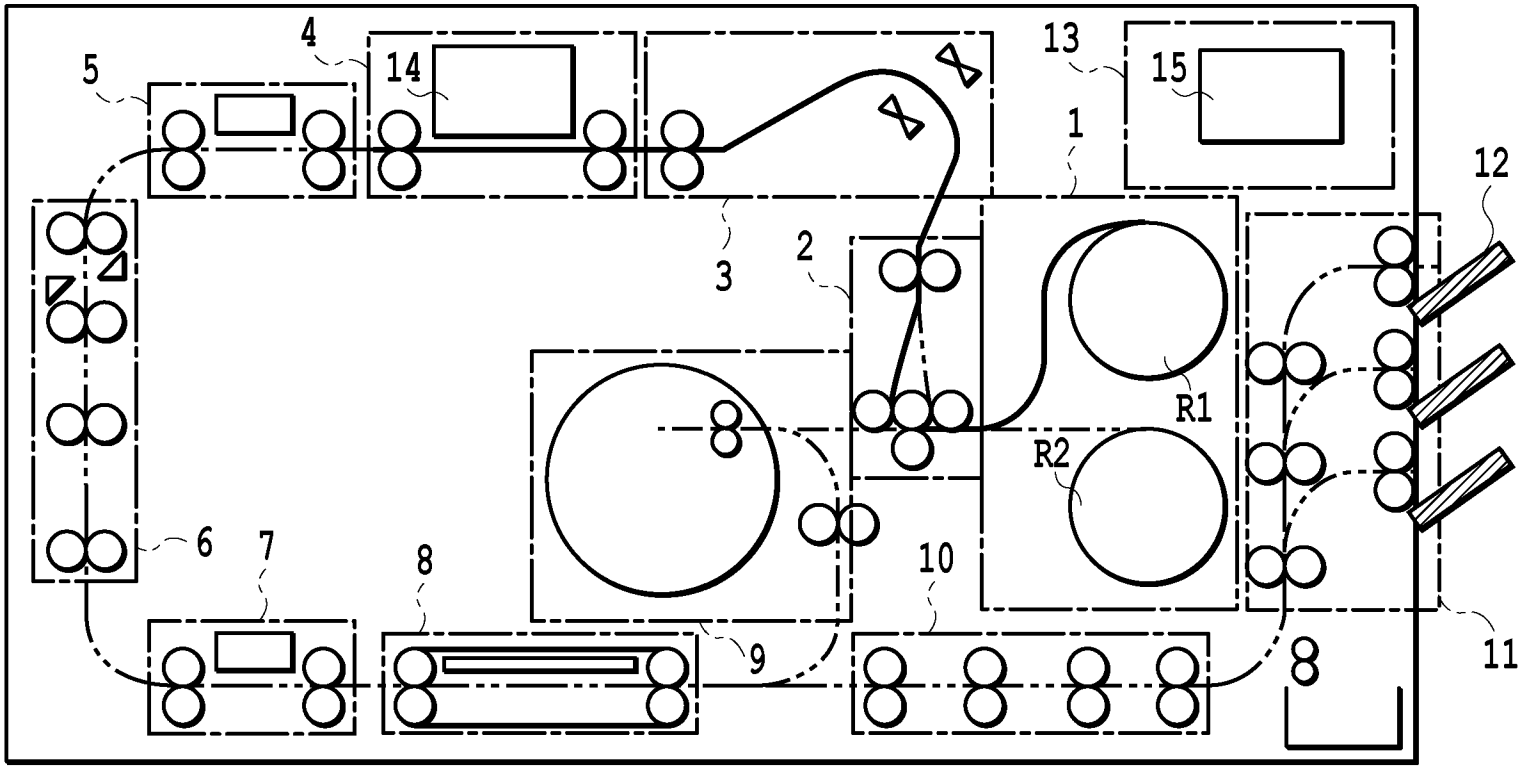
FIG. 14 is a diagram showing a state where the sheet starts to be conveyed out again.

FIG. 14 is a diagram showing a state where the sheet with the inspection pattern being printed is conveyed back to the upstream side, and afterward is again conveyed to the downstream side. The sheet is corrected in conveyance misalignment in the sheet corrective unit 3, passes under the printing unit 4 with no oblique movement or serpentine movement, and is conveyed to the reading unit 5.

FIG. 9 is again referred to. In the sheet in which the conveyance misalignment is corrected in step S17, the inspection pattern is read by the reading unit 5. The read inspection pattern is cut in a predetermined length in the cutter unit 6 (step S9). An image of the color shading inspection pattern is analyzed (step S10), and the color shading inspection data is transmitted to the controller 15 (step S11). The inspection pattern is cut by the cutter unit 6, which is put into a dust bin 105 (step S12).

Figure 15:
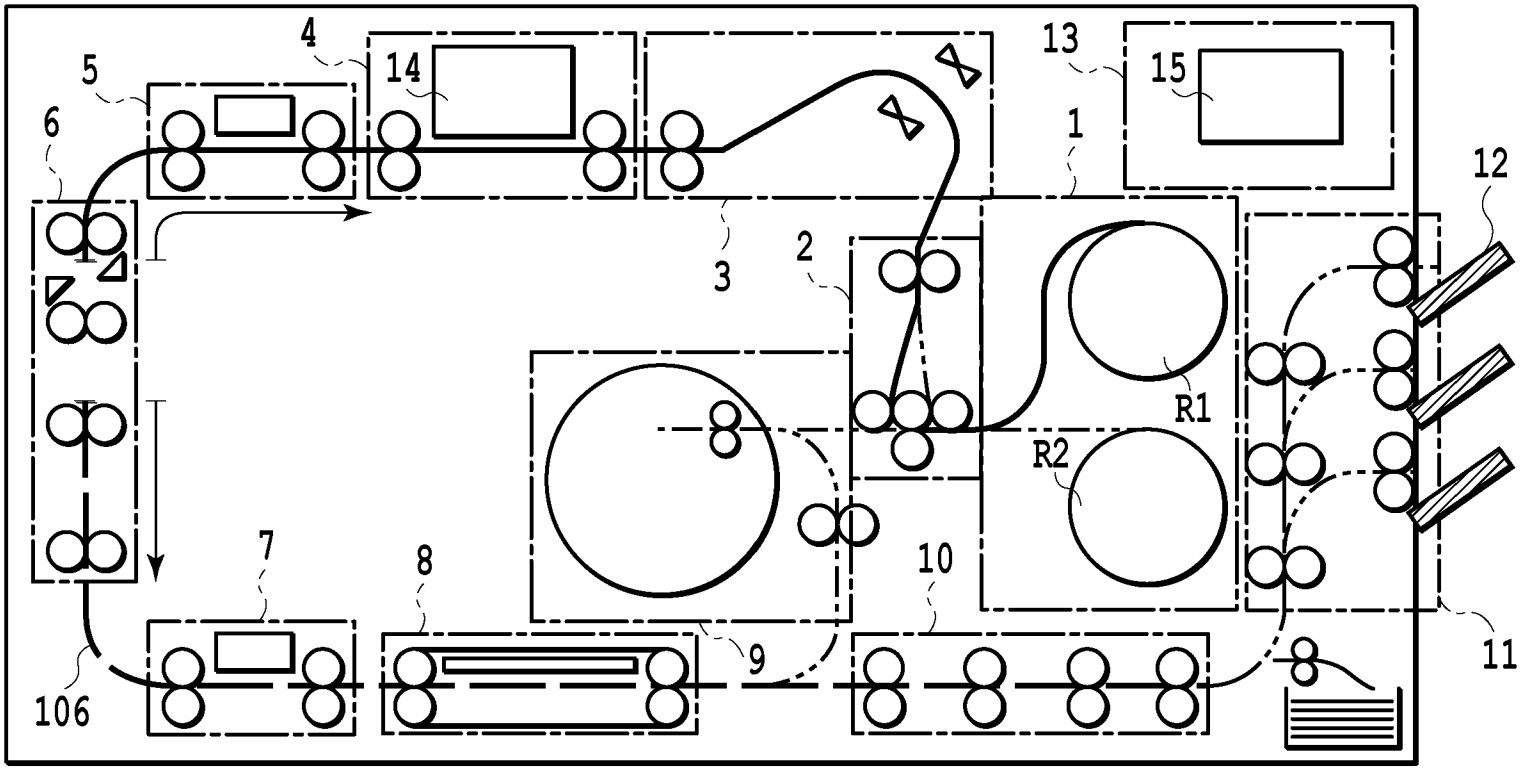
FIG. 15 is a diagram showing a state where the inspection pattern is cut for separation.

FIG. 15 is a diagram showing a state where the inspection pattern is cut by the cutter unit 6 for separation. The upstream side of the sheet in which all the inspection patterns are separated by the cutter 6 is reeled back to the sheet supply unit 1.

By analyzing the image information after the ink read by the reading unit 5 is dried, a control parameter of the print head is obtained to control calibration of color shading in the printing apparatus, that is, the ejection amount of the ink.

In a case of performing the color shading and correction in this manner, the sheet conveying-back operation is performed until at least all the inspection patterns, preferably the sheet front end comes to the upstream side over the sheet corrective unit 3. In addition, the conveyance misalignment of the sheet is again corrected in the sheet corrective unit 3, and the reading of the inspection pattern is performed in the reading unit 5. Since the reading of the inspection pattern is performed in a state where the sheet conveyance misalignment (oblique movement and serpentine movement) is eliminated and the inspection pattern does not deviate in position to the scanner unit, the accurate inspection can be performed. According to the present embodiment, both of an automatic inspection and a high print quality of the printing apparatus can be performed. Further, since the inspection device is built in the printing apparatus, the external device such as the external scanner is not required.

In the present embodiment, in regard to the arrangement order of the cutter unit 6 and the drying unit 8, the drying unit 8 is arranged downstream of the cutter unit 6, but the drying unit 8 may be arranged upstream of the cutter unit 6. In the present embodiment, it is estimated that the reeling-back speed is equal to the conveying speed, but in a case where the drying time in the drying unit 8 is not sufficient for the color shading detection, the reeling-back speed in the drying unit 8 may slow down to sufficiently dry the inspection pattern.

In the aforementioned embodiment, the sheet on which the inspection pattern dried by the drying unit 8 is printed is reeled back to the reeling unit and the sheet supply unit 1, and then is again conveyed in the forward direction to correct the conveyance misalignment for reading. The present invention is not limited to this embodiment, but there may be adopted an embodiment where after the sheet on which the inspection pattern is printed is dried in the drying unit 8, the sheet is not reeled on the sheet reeling unit 9 and is not conveyed back. Further, the sheet is conveyed through anther path from the decal unit 2 to the upstream side of the sheet corrective unit 3 to correct the conveyance misalignment of the sheet, thus reading the inspection pattern.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-231288, filed Oct. 21, 2011, which is hereby incorporated by reference herein in its entirety.

What is claimed is:

1. A printing apparatus for applying ink on a continuous sheet to perform printing thereon, the apparatus comprising:

a printing unit including a print head of an inkjet type;

a corrective unit positioned upstream of the printing unit to correct a conveyance misalignment of the sheet on which printing is performed by the printing unit;

a reading unit positioned downstream of the printing unit to read an inspection pattern that is printed on the sheet by the printing unit;

a drying unit configured to dry the sheet on which the ink is applied by the printing unit; and a control unit, wherein, based upon control of the control unit, the sheet, on which the inspection pattern is printed, is dried by the drying unit, and the sheet is afterward conveyed back to the corrective unit and again corrected for conveyance misalignment by the corrective unit prior to the inspection pattern being read by the reading unit.

2. A printing apparatus according to claim 1, further comprising:

a sheet supply unit, wherein, based upon the control of the control unit, a sheet conveyed out from the sheet supply unit, on which the inspection pattern is printed, is dried by the drying unit, and the sheet is afterward conveyed back to the sheet supply unit and a front end of the sheet is conveyed back to the upstream side of the corrective unit, such that the sheet is again conveyed out to be corrected by the corrective unit.

3. A printing apparatus according to claim 2, further comprising:

a reeling unit downstream of the drying unit to reel the sheet, wherein at least a part of the sheet passing the drying unit is reeled on the reeling unit before being conveyed back to the sheet supply unit.

4. A printing apparatus according to claim 1, wherein, based upon the control of the control unit, a color shading inspection and an ejection failure inspection of a nozzle in the print head can be selectively performed, and at the time of the ejection failure inspection, an ejection failure inspection pattern is printed on the sheet by the printing unit, and the printed ejection failure inspection pattern is immediately read by the reading unit.

5. An inspection method comprising:

correcting a conveyance misalignment of a continuous sheet by a corrective unit;

printing an inspection pattern onto the corrected sheet by a print head of an inkjet type;

conveying the printed sheet back to the corrective unit;

again correcting a conveyance misalignment of the printed sheet by the corrective unit; and reading the inspection pattern of the printed sheet.

* * * * *